US006546860B1

(12) United States Patent
Heiler

(10) Patent No.: US 6,546,860 B1
(45) Date of Patent: Apr. 15, 2003

(54) DAMPENING UNIT FOR A PRINTING PRESS

(75) Inventor: Peter Heiler, Forst (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/528,422

(22) Filed: Mar. 17, 2000

(30) Foreign Application Priority Data

Mar. 17, 1999 (DE) ..... 199 11 783

(51) Int. Cl.[7] ..... B41F 7/26
(52) U.S. Cl. ..... 101/147; 101/148; 101/132.5
(58) Field of Search ..... 101/132.5, 147, 101/148, 350.1, 351.1, 351.2, 351.3

(56) References Cited

U.S. PATENT DOCUMENTS

| | | | | |
|---|---|---|---|---|
| 4,290,360 A | * | 9/1981 | Fischer | 101/148 |
| 4,440,081 A | * | 4/1984 | Beisel | 101/148 |
| 4,949,639 A | | 8/1990 | Burns | |
| 5,027,705 A | * | 7/1991 | Guaraldi et al. | 101/148 |
| 5,191,835 A | * | 3/1993 | Blanchard | 101/148 |
| 5,540,145 A | | 7/1996 | Keller | |
| 5,823,109 A | * | 10/1998 | Hummel et al. | 101/350.4 |
| 5,865,116 A | * | 2/1999 | Keller | 101/148 |
| 6,354,202 B1 | * | 3/2002 | Heiler | 101/148 |

FOREIGN PATENT DOCUMENTS

| | | | |
|---|---|---|---|
| CH | 509 156 | | 8/1971 |
| DE | 36 37 460 C2 | | 7/1987 |
| DE | 3722519 A1 | * | 4/1988 |
| DE | 91 10 345.2 | | 11/1991 |
| DE | 43 12 523 A1 | | 10/1994 |
| EP | 0 462 490 A1 | | 12/1991 |
| EP | 0 893 251 B1 | | 1/1999 |

OTHER PUBLICATIONS

Anonymous: "Printing without Isopropanol (IPA)", *GTO 52 Tips, Heidelberger Druckmaschinen, Heidelberg, Germany,* pp. 2–4 No Date.

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Ralph E. Locher

(57) ABSTRACT

A dampening unit for a printing press contains a first roller and a second roller that together form a slip gap. The dampening unit is distinguished in that a pivot axis, about which the first roller is pivotably supported against the second roller, extends through a center axis of the first roller and substantially parallel to a tangential line that is located on a line L which extends through the slip gap.

13 Claims, 4 Drawing Sheets

DAMPENING UNIT FOR A PRINTING PRESS

BACKGROUND OF THE INVENTION

FIELD OF THE INVENTION

The invention relates to a dampening unit for a printing press having a first roller and a second roller, which together form a slip gap.

One such dampening unit is described in Published, European Patent Application EP 0 893 251 A2; it includes an immersion roller, a slip roller, and an intermediate roller. The slip roller rotates with a surface velocity that is different from a surface velocity of the intermediate roller. As a consequence, a roller gap formed by the slip roller together with the intermediate roller is a so-called slip gap. The afore-mentioned rollers carry only humectant, and not an emulsion of printing ink and humectant.

U.S. Pat. No. 4,949,639 also describes another dampening unit, which includes a plurality of rollers each of which contains rubber and rotates at the surface velocity of a plate cylinder. All the rollers of the dampening unit carry humectant and printing ink during printing. The dampening unit is thus a so-called direct-film or emulsion-film dampening unit.

In the brochure "Printing without Isopropanol (IPA)", in the brochure series "GTO 52-Tips", issued by Heidelberger Druckmaschinen AG, a further direct-film dampening unit is mentioned, for whose operation and care tips are given in the brochure.

Other prior art is also described in U.S. Pat. No. 5,540,145, Published, European Patent Application EP 0 462 490 A1, Published, Non-Prosecuted German Patent Applications DE 36 37 460 A1 and DE 37 22 519 A1, and German Patent DE 43 12 523 C2.

SUMMARY OF THE INVENTION

It is accordingly an object of the invention to provide a dampening unit for a printing press which overcomes the above-mentioned disadvantages of the prior art devices of this general type.

With the foregoing and other objects in view there is provided, in accordance with the invention, a dampening unit for a printing press, including a first roller having a center axis; and a second roller jointly forming a slip gap with the first roller, the first roller being swivably mounted about a pivot axis for positioning the first roller in relationship to the second roller, the pivot axis extends through the center axis of the first roller and is substantially parallel to a tangential line running through the slip gap.

One of the advantages of the dampening unit of the invention is that a shear force occurring in the slip gap cannot engender any torque that pulls the first roller from the second roller or forces it toward the second roller. As a consequence, the roller pressure in the slip gap and the film of humectant, or preferably an emulsion of printing ink and humectant, fed through it remain constant.

In addition, the dampening unit of the invention is highly suitable as an emulsion film dampening unit for processing an alcohol-free humectant, which in turn is ecologically advantageous. Experience shows that if an emulsion of printing ink and humectant is sheared in an emulsion film dampening unit, a greater shear force occurs than when an ink-free humectant film is sheared in a so-called alcohol dampening unit. The high shear forces, in the emulsion dampening units known from the prior art, dictate structural and functional limitations. In contrast to this, such limitations no longer exist in the dampening unit of the invention.

For instance, it is easily possible in the dampening unit of the invention to assign the first roller a force storing device, such as a spring, for storing a positioning force that pivots the first roller against the second roller about the pivot axis. The use of such a force storing device that elastically holds the first roller against the second roller and that acts resiliently upon a slight depositioning motion of the first roller away from the second roller, is extremely advantageous with a view to precise metering of an emulsion of printing ink and humectant.

Other features which are considered as characteristic for the invention are set forth in the appended claims.

Although the invention is illustrated and described herein as embodied in a dampening unit for a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
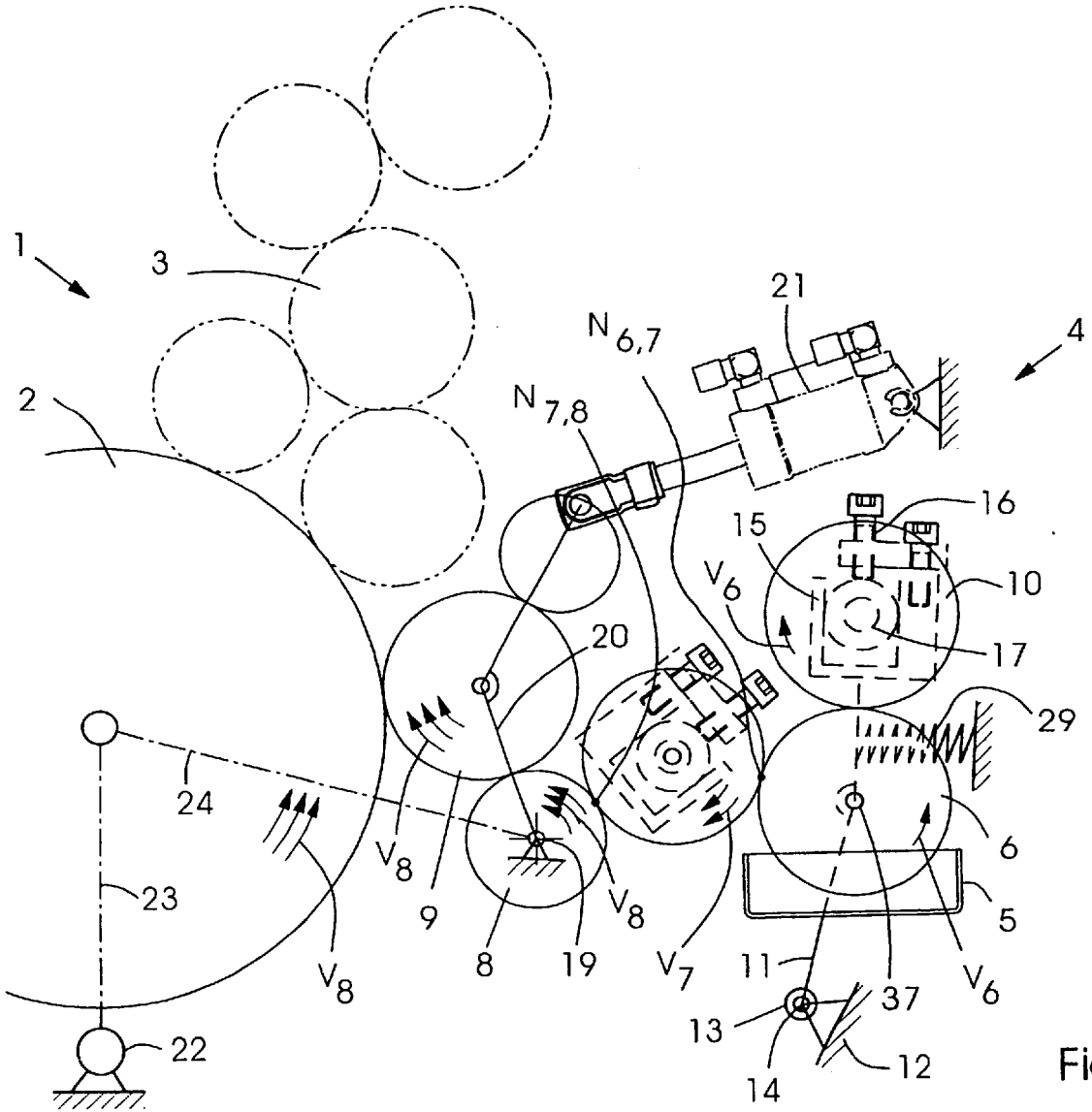
FIG. 1 is a diagrammatic, side-elevational view of a dampening unit with a first and a second roller and with a roller carrier, in which the second roller is rotatably supported according to the invention.

In all the figures of the drawing, sub-features and integral parts that correspond to one another bear the same reference symbol in each case. Referring now to the figures of the drawings in detail and first, particularly, to FIG. 1 thereof, there is shown a printing press 1 in fragmentary form. The fragment shows a form cylinder 2, an inking unit 3, and a dampening unit 4 which operates with an alcohol-free humectant and is embodied as a so-called direct-film or emulsion dampening unit, of the printing press 1. The printing press 1 is embodied as a rotary printing press for sheet-fed printing and also includes a rubber blanket cylinder and a counterpressure cylinder, which are not shown and which together with the form cylinder 2 form an offset printing unit.

The moistening unit 4 contains a first roller 6, disposed as an immersion roller in a tublike humectant container 5. A second roller 7 is provided, which is in rolling contact with the first roller 6 and acts as a transfer roller. A third roller 8 is provided, which is in rolling contact with the second roller 7 and acts an axially traversing friction roller. A fourth roller 9 is provided and is an applicator roller in rolling contact with the third roller 8 and the form cylinder 2. Finally, a fifth roller 10 is provided, acting as a metering roller, which is in rolling contact solely with the first roller 6. Each of the rollers 6–9, which form the shortest possible transport path of the humectant from the humectant container 5 to the form cylinder 2, and also the fifth roller 10 are provided on their circumference with a coating $B_6$–$B_{10}$ (FIG. 2) with an affinity for ink and during printing carry an emulsion of printing ink and humectant on their thus-coated circumferential surface. The coatings $B_7$, $B_9$ and $B_{10}$ of rollers 7, 9 and 10 are soft rubber coatings, and the coatings $B_6$ and $B_8$ of rollers 6 and 8 are hard rubber or plastic coatings and for instance contain hard nylon (trade name RILSAN).

The rollers 6 and 10 are rotatably supported in a common first carrier 11, which is pivotable about a first pivot bearing 13 disposed on a frame 12 and having a pivot axis 14. The first carrier 11 contains two bearing plates, between which journals of the rollers 6 and 10 are disposed. By an adjusting device 15 disposed on the first carrier 11, a pressure between the rollers 6 and 10 can be adjusted, in that by a rotation of an adjusting thread 16, such as a screw, of the adjusting device 15 a shaft journal 17 of the fifth roller 10 is adjustable toward and away from the first roller 6, depending on the direction of rotation of the adjusting thread 16.

A second carrier 20 is supported pivotably about a second pivot bearing 19, disposed on the frame 12 and coaxially with the third roller 8; the fourth roller 9 is rotatably supported in the second carrier 20. The second carrier 20 is engaged by an adjusting drive 21 for selectively positioning the fourth roller 9 toward and away from the form cylinder 2. The adjusting drive 21 is a pneumatic double-action work cylinder—that is, one that can be both extended and retracted by the imposition of pressure fluid—which is pivotably connected to the frame 12 and, via its piston rod, to the second carrier 20.

An electric motor 22 functioning as a main motor of the printing press 1 drives the form cylinder 2 and the rollers 8 and 9 with substantially the same circumferential surface velocity $v_8$. To that end, the motor 22 is connected for driving the form cylinder 2 and the third roller 8 via wheel gears 23 and 24, which are shown schematically. The fourth roller 9 is rotated jointly with the third roller 8 by friction.

Figure 4:
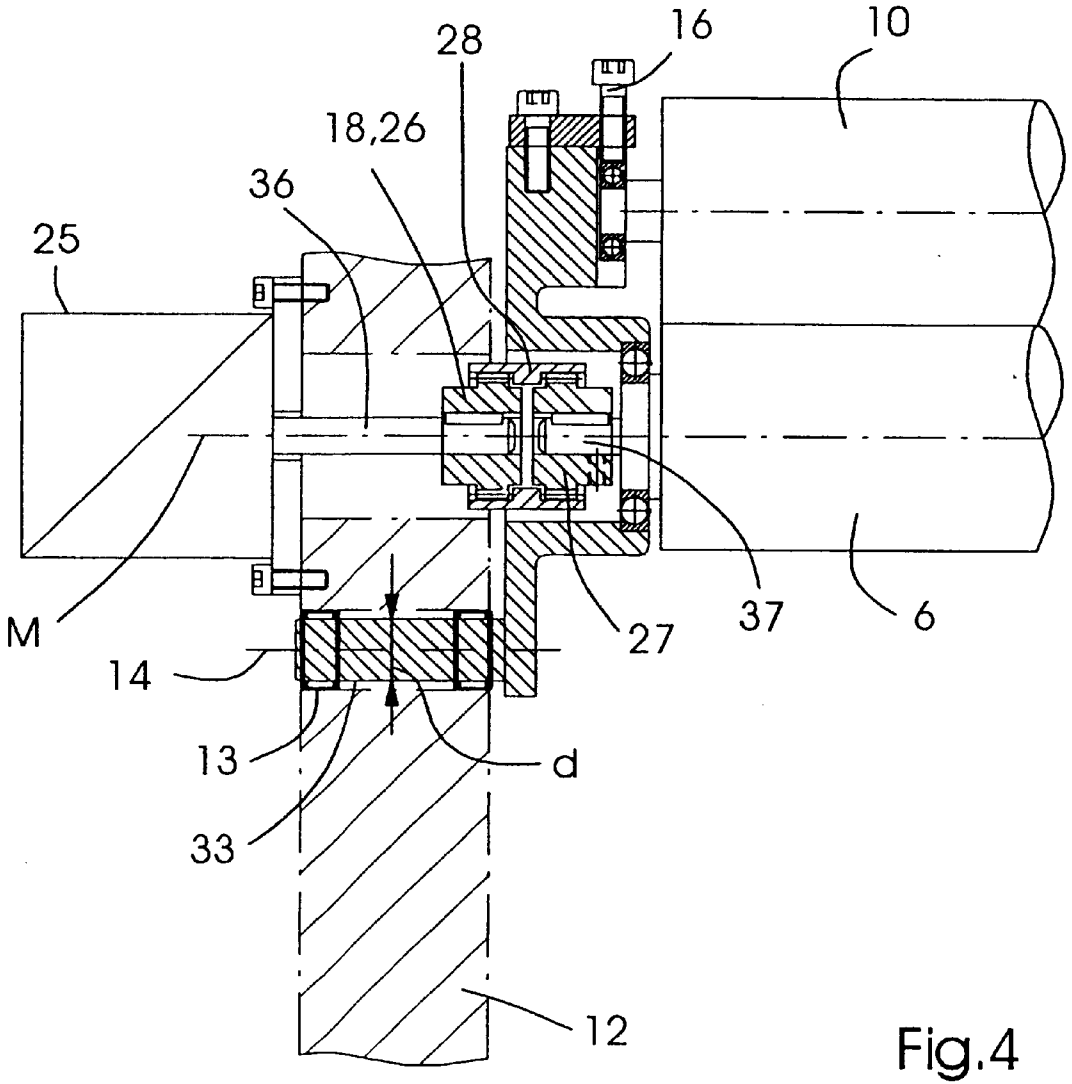
FIG. 4 is a sectional view of a variant for the disposition of a motor of the dampening unit that drives the first roller to rotate.

A second electric motor 25—see FIG. 4—functioning as a separate motor of the dampening unit 4 drives the rollers 6 and 10 rotationally with the same circumferential velocity $v_6$ as each other, which is less than the circumferential velocity $v_8$. As seen in FIG. 4, the second motor 25 is for that purpose connected for driving to the first roller 6 via a coupling 18 that transmits only torques, and the fifth roller 10 is frictionally rotated jointly with and by the first roller 6.

In FIG. 1, correspondingly stepped selected rotation arrows symbolically indicate that a circumferential surface velocity $v_7$ of the second roller 7, while less than the circumferential surface velocity $v_8$, is nevertheless greater than the circumferential surface velocity $v_6$.

A prestressed energy or force storing device 29, in a form of a spring 29 that can be subjected to pressure and is helically wound, engages the first carrier 11, so that the carrier 11 is pivoted counterclockwise, in terms of FIG. 1, about the pivot axis 14. As a consequence, the force storing device 29 keeps the first roller 6 in elastic contact pressure against the second roller 7. The force storing device 29 acting to force the first roller 6 toward second roller 7 acts resiliently relative to forces in a roller gap (or nip) $N_{6,7}$ and forces the first roller 6 away from the second roller 7. A press strip width within the roller gap $N_{6,7}$ between the rollers 6 and 7 is determined by a normal force $F_{N,6,7}$—see FIG. 2—that is brought to bear by the force storing device 29. In other words, the force storing device 29 presses the first roller 6 against the second roller 7. The moistened circumferential surface of the second roller 7 forms a stop for the first roller 6. No other stops are needed for determining the approach position of the roller 6.

The roller gap $N_{6,7}$, because of the difference between the circumferential surface velocities $v_6$ and $v_7$, and a roller gap $N_{7,8}$ between the rollers 7 and 8, because of the difference between the circumferential surface velocities $v_7$ and $v_8$, are each a so-called slip gap.

In the press or roller gaps $N_{6,7}$ and $N_{7,8}$ with slip, the fluid transported through the roller gaps $N_{6,7}$ and $N_{7,8}$—in this case the printing ink and humectant emulsion—undergo not only splitting, as in a slip-free roller gap, but shearing as well.

Figure 2:
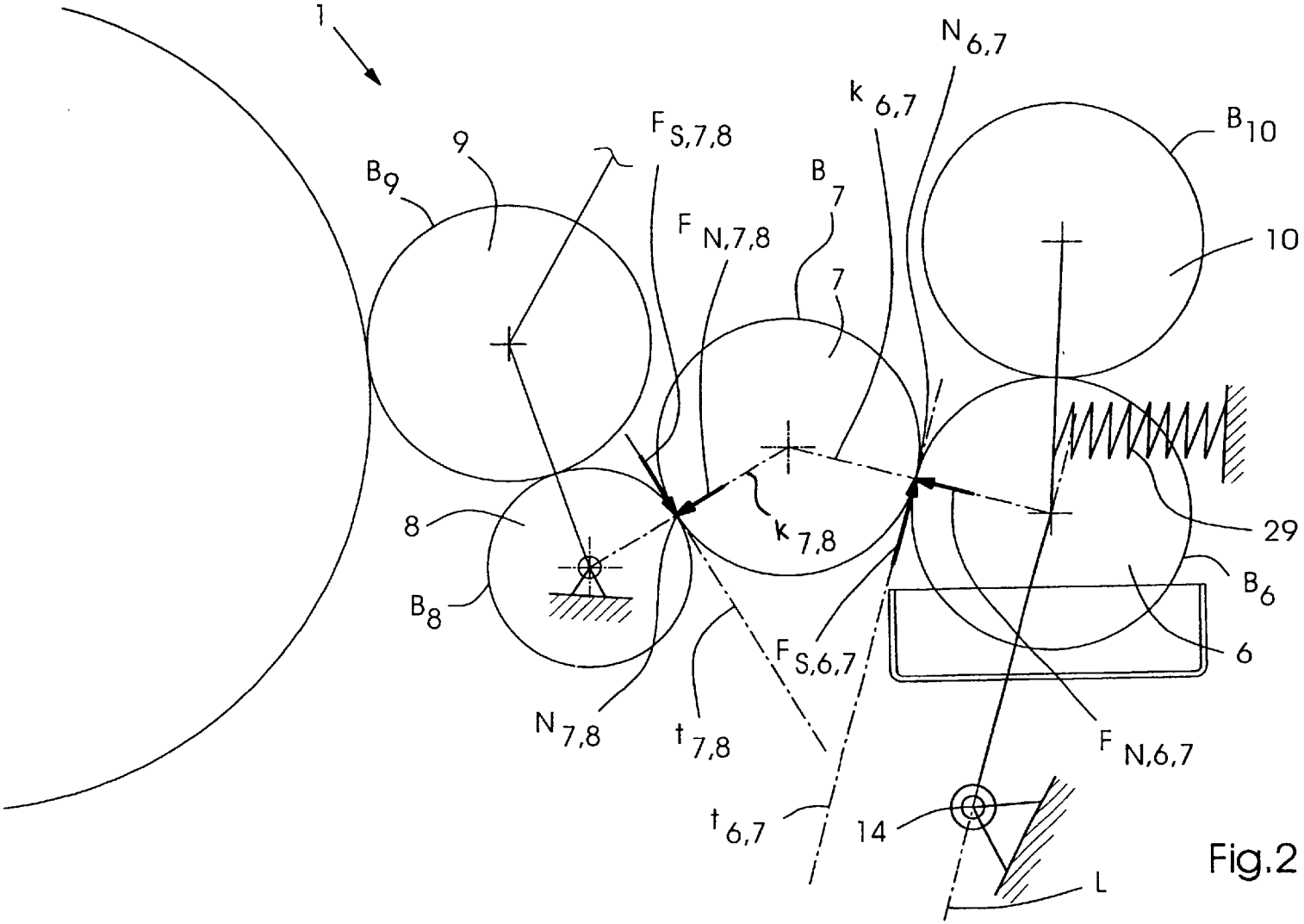
FIG. 2 is a side-elevational view of a disposition of a pivot axis of the roller carrier.

In FIG. 2, it is shown that a force action line $k_{6,7}$ corresponds to a normal force $F_{N,6,7}$ of a center point of the rollers 6 and 7, and a force action line $k_{7,8}$ corresponds to the normal force $F_{N,7,8}$ of a center point of the rollers 7 and 8. Along a common tangential line $t_{6,7}$ of the rollers 6 and 7, which is determined by the roller gap $N_{6,7}$, a fluid shear force $F_{S,6,7}$ is operative, and along a common tangential line $t_{7,8}$ of the rollers 7 and 8, a fluid shear force $F_{S,7,8}$ is operative.

Because of the disposition of the pivot axis 14 of the first carrier 11 on a line L that passes through a center axis M of the first roller 6 and parallel to the tangential line $t_{6,7}$ and perpendicular to a force action line $k_{6,7}$ or the center point of the rollers 6 and 7, it is assured that the shear force $F_{S,6,7}$ cannot exert a torque on the first carrier 11 that impairs the positioning of the first roller 6 to the second roller 7, or in other words forces the first roller 6 toward the second roller 7 or away from the second roller 7. If any changes in the magnitude of the shear force $F_{S,6,7}$ occur, for instance because of changes in one of the circumferential surface velocities $v_6$ or $v_7$ of the rollers 6 and 7, the normal force $F_{N,6,7}$ resulting from the prestressing of the force storing means 29, and thus the established pressure between the rollers 6 and 7, remain constant.

Figure 3:
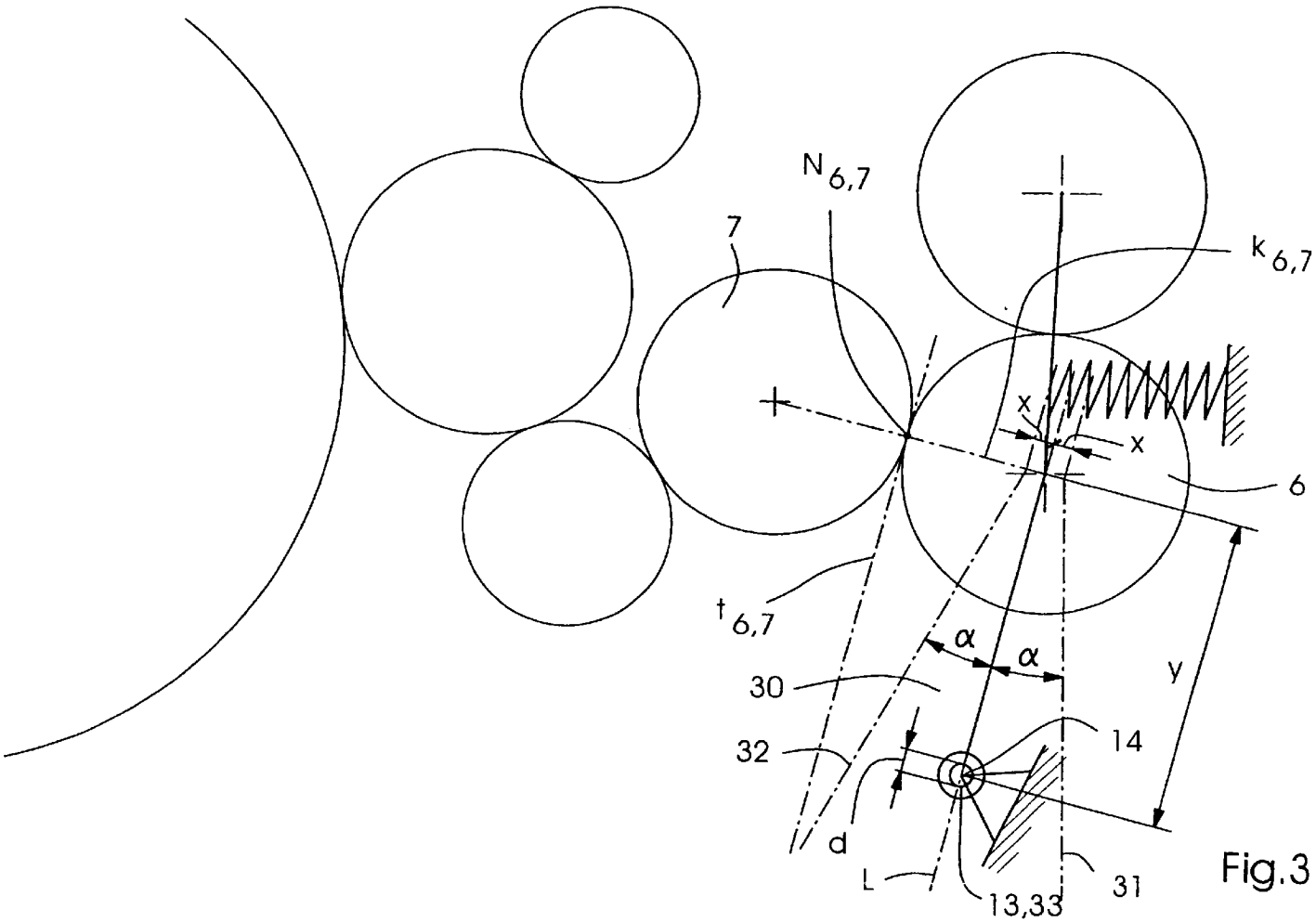
FIG. 3 is a side-elevational view of the disposition of the pivot axis inside a wedge-shaped tolerance range.

In many applications, it will suffice for the pivot axis 14 to be disposed within a wedge-shaped tolerance range 30 surrounding the line L. As shown in FIG. 3, the location of tolerance limits 31 and 32 on both sides of the tolerance range 30 are each defined by a respective angle a between the line L and the applicable tolerance limit 31 or 32. The angle a is less than or equal to 15°.

Given the short tangential spacing y shown, it is possible to expand the tolerance range 30, by shifting each of the tolerance limits 31 and 32 outward by a normal spacing x from the line L and shifting the center axis M outward along the force action line $k_{6,7}$. As a result, the intersection of each of the tolerance limits 31 and 32 with the force action line $k_{6,7}$ is offset by the normal spacing x relative to the line L. The normal spacing x is less than or equal to the product of a bearing diameter d—for instance, the diameter of a bearing journal 33—of the first pivot bearing 13 and the coefficient of friction of the first pivot bearing 13, which characterizes the friction between the bearing journal 33 and a bearing bore.

In applications in which it is impossible, for instance because of the lack of installation space, to position the pivot axis 14 precisely on the line L, the pivot axis 14 should be disposed on the side of the line L and inside the half of the tolerance range 30 that is located in the direction of the second roller 7. In terms of FIG. 3, this refers to the left-hand half of the tolerance range 30, located between the line L and the tolerance limit 32.

As a result, a self-regulating contact pressure of the first roller 6 against the second roller 7 is obtained. An increase in the shear force $F_{S,6,7}$ causes a torque that pivots the first roller 6 slightly away from the second roller 7 —without any loss of contact because of the printing ink and humectant emulsion in the roller gap $N_{6,7}$—and as a result of this torque, the normal force $F_{N,6,7}$ exerted by the first roller 6 on the second roller 7 is automatically reduced. The magnitude of the shear force $F_{S,6,7}$ depends in turn on the normal force $F_{N,6,7,}$ so that as a consequence of the reduction in the normal force $F_{N,6,7,}$ the shear force $F_{S,6,7}$ is also reduced. The dampening unit 4 reacts in the opposite way in the event of a decrease in the shear force $F_{S,6,7}$.

In FIG. 4, one possible variant for initiating a drive force $F_A$, which generates the velocity difference in the roller gap $N_{6,7}$, is shown. In this variant, it is assured that the drive force $F_A$ will not transmit any torque to the first carrier 11 that pivots the first roller 6 about the pivot axis 14 and thus unfavorably affects the constancy of the pressure in the roller gap $N_{6,7}$.

According to the variant, this is assured in that the motor 25 secured to the frame 12 transmits its torque to the first roller 6 via the coupling 18 in a manner free of restoring forces. The coupling 18 connects a shaft 36 rotated by the motor 25, such as a motor shaft of the motor 25, to a journal-like roller shaft 37 of the first roller 6, which shaft is coaxial with the shaft 36. The coupling 18 is embodied as a sleeve coupling, and it contains two permanently joined coupling halves, namely a gear wheel 26 seated on the shaft 36 in a manner fixed against relative rotation and a gear wheel 27 seated on the roller shaft 37 in a manner fixed against relative rotation. The gear wheels 26 and 27 are enclosed by a flexible sleeve 28 which on its inside has two sets of teeth with which the gear wheels 26 and 27 mesh.

Instead of the coupling 18 shown, a flexible shaft, a double Cardan joint, a curved tooth coupling, a parallel crank coupling, or some other compensation coupling for compensating for deviations in inclination and/or alignment can be used for the driving connection of the motor 25 to the first roller 6.

The roller shaft 37 predetermines the center axis M of the first roller 6, about which the first roller 6 rotates.

Instead of the motor 25, a brake for slowing down the rotation of the roller 6 and for generating the slip in the roller gaps $N_{6,7}$ and $N_{7,8}$ can also be provided. In that case, the brake would be disposed in stationary fashion on the frame 12.

I claim:

1. A dampening unit for a printing press, comprising:

a first roller having a center axis;

a second roller jointly forming a slip gap with said first roller, said first roller being swivably mounted about a pivot axis for positioning said first roller in relationship to said second roller, said pivot axis located such that a line extending through said pivot axis and through said center axis of said first roller is substantially parallel to a tangential line running through said slip gap; and a force storing device supplying an elastic force for resiliently biasing said first roller against said second roller.

2. The dampening unit according to claim 1, including a third roller disposed adjacent to said second roller and forming a roller gap therewith.

3. The dampening unit according to claim 2, wherein said roller gap between said second roller and said third roller is a slip gap.

4. The dampening unit according to claim 1, wherein said first roller and said second roller have, in each case, an ink-friendly coating.

5. The dampening unit according to claim 4, wherein said ink-friendly coating is made of a material selected from the group consisting of rubber materials and manmade materials including plastic.

6. The dampening unit according to claim 1, wherein said force storing device is a spring.

7. The dampening unit according to claim 1, including:

a frame;

a pivot bearing defining said pivot axis and disposed in said frame; and a carrier rotatably supporting said first roller for pivoting said first roller about said pivot axis, and said carrier connected to said frame via said pivot bearing defining said pivot axis.

8. The dampening unit according to claim 7, including:

a motor disposed on said frame; and a coupling unit coupling said motor to said first roller for rotationally driving said first roller.

9. The dampening unit according to claim 1, wherein said first roller is an immersion roller.

10. The dampening unit according to claim 2, wherein said third roller is a traversing friction roller.

11. The dampening unit according to claim 2, including a fourth roller, and said third roller resting on said fourth roller.

12. The dampening unit according to claim 11, including a form cylinder, and said fourth roller is an applicator roller that rests on said form cylinder.

13. A printing press, comprising:

a dampening unit for a printing press, including:

a first roller having a center axis;

a second roller jointly forming a slip gap with said first roller, said first roller being swivably mounted about a pivot axis for positioning said first roller in relationship to said second roller, said pivot axis located such that a line extending through said pivot axis and through said center axis of said first roller is substantially parallel to a tangential line running through said slip gap; and a force storing device supplying an elastic force for resiliently biasing said first roller against said second roller.

* * * * *